US006170207B1

(12) United States Patent
Saindon

(10) Patent No.: US 6,170,207 B1
(45) Date of Patent: Jan. 9, 2001

(54) FRAME WITH WATER STOP AND METHOD OF INSTALLATION

(76) Inventor: Michael Lee Saindon, 3029 Skyline Dr., Oceanside, CA (US) 92056

( * ) Notice: Under 35 U.S.C. 154(b), the term of this patent shall be extended for 0 days.

(21) Appl. No.: 09/066,085

(22) Filed: Apr. 24, 1998

(51) Int. Cl.[7] ..... E04C 3/02

(52) U.S. Cl. ..... 52/204.2; 52/97; 52/204.1; 52/210; 52/302.1; 49/408; 49/471

(58) Field of Search ..... 52/209, 204.2, 52/302.1, 97, 204.1, 210; 49/408, 471

(56) References Cited

U.S. PATENT DOCUMENTS

| | | | | |
|---|---|---|---|---|
| 2,733,487 | * | 2/1956 | Hauck | 49/408 |
| 3,199,156 | | 8/1965 | Reigelman . | |
| 3,314,201 | * | 4/1967 | Reigelman | 52/209 |
| 3,638,372 | * | 2/1972 | Rosenthal | 52/209 |
| 4,073,035 | * | 2/1978 | Baus | 49/408 |
| 4,125,141 | * | 11/1978 | Stillwell | 49/408 |
| 4,922,661 | | 5/1990 | Dallaire et al. . | |
| 5,121,951 | | 6/1992 | Harbom et al. . | |
| 5,321,921 | * | 6/1994 | Holt | 52/97 |
| 5,653,068 | * | 8/1997 | Moody et al. | 52/97 |
| 5,836,120 | * | 11/1998 | DeBower | 52/209 |
| 5,887,387 | * | 3/1999 | Dallaire | 49/408 |

FOREIGN PATENT DOCUMENTS

| | | | | |
|---|---|---|---|---|
| 598791 | * | 5/1960 | (CA) | 52/209 |
| 901388 | * | 5/1972 | (CA) | 52/209 |
| 1435117 | * | 5/1976 | (GB) | 52/209 |
| 2220219 | * | 1/1990 | (GB) | 52/209 |

* cited by examiner

*Primary Examiner*—Carl D. Friedman
*Assistant Examiner*—Dennis L. Dorsey
(74) *Attorney, Agent, or Firm*—Eric Karich

(57) ABSTRACT

The present invention provides an exterior wall frame construction for excluding rain, the construction having a frame and a water stop. The frame has a head, a sill, and two jambs. The two jambs are each connected to the head and the sill for holding a door or a window. The water stop is located at the head of the frame. The water stop has a top surface, a front sidewall, a rear sidewall, and a pair of end caps. The front sidewall extends upwardly from the top surface to form a barrier against water leaking over the frame from the exterior of the structure. The front sidewall has at least one weep hole located adjacent to the top surface, the weep hole being a conduit through the front sidewall allowing water to drain from the water stop to the outside of the building. The top surface is preferably slanted downward from the rear sidewall to the front sidewall, so that any water leaking onto the top surface runs down to the front sidewall and out the weep hole. In various embodiments, the water stop is either attached to or integral with the head of the frame.

13 Claims, 3 Drawing Sheets

FRAME WITH WATER STOP AND METHOD OF INSTALLATION

BACKGROUND OF THE INVENTION

1. Field of the Invention

This invention relates to a door or window frame construction and method of installation, the frame construction having a water stop in its head, the water stop providing an improved resistance to water leakage.

2. Description of Related Art

The prior art describes various doors (and windows) wherein the sill of the door includes a construction known as a "water stop." The water stop includes a basin in the sill that collects water running off the door. The water stop then channels the water to the exterior of the structure through a series of holes known as a "weep holes." By channeling the water out through the weep holes, the frame of the door prevents water from leaking into the house. Patents that describe this construction include Riegelman, U.S. Pat. No. 3,199,156 and Dallaire el al., U.S. Pat. No. 4,922,661.

The prior art teaches the use of a water stop in the sill of the door, but it does not teach the use of a water stop in the head of the door. Since the head of the frame is generally built directly into the wall of the structure, it does not appear logical to include a water stop in the head of the frame. Yet there is a long-felt need for a structural improvement in the construction of frames to prevent leakage over the top of the frame. This need is especially great when an original door is removed and replaced with a new door. The replacement frame is often prone to leakage. The present invention fulfills the need for an improved frame resistant to this type of leakage and provides further related advantages as described in the following summary.

SUMMARY OF THE INVENTION

The present invention teaches certain benefits in construction and use that give rise to the objectives described below.

The present invention provides an exterior wall frame construction for excluding rain or other moisture. The frame has a head, a sill, and two jambs. The two jambs are each connected to the head and the sill for holding a door or a window. The water stop is located at the head of the frame. The water stop has a top surface, a front sidewall, and a water containment means. The front sidewall extends upwardly from the top surface to form a barrier against water leaking over the frame from the exterior of the structure. The front sidewall has at least one weep hole located adjacent to the top surface, the weep hole being a conduit through the front sidewall allowing water to drain from the water stop to the outside of the building. In its preferred configuration, the water containment means is a rear sidewall extending upwardly from the top surface to prevent water from leaking from the top surface of the head into the interior of the structure. Furthermore, the top surface is preferably slanted downward from the rear sidewall to the front sidewall, so that any water leaking onto the top surface runs down to the front sidewall and out the weep hole. Finally, the water containment means preferably further includes a pair of end caps that snap onto the front and rear sidewalls and the top surface to prevent water leakage over the sides of the frame. In various embodiments, the water stop is either attached to or integral with the head of the frame.

A primary objective of the present invention is to provide a frame for a door or window that does not leak, thereby having advantages not taught by the prior art.

Another objective is to provide a water stop on the head of a door or window frame, the water stop being positioned to exclude water that leaks into the wall of a structure.

A further objective is to provide a water stop that can be used to convert a prior art window into an improved frame construction that is resistant to leakage.

A further objective is to provide an improved frame construction that can be used in new construction and still provide the benefits of a water stop to avoid leakage.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

The above described drawing figures illustrate the invention, an exterior wall frame 20 construction for excluding water such as rain. The exterior wall frame 20 construction is used either for doors, windows, or any other framed portion of the exterior wall of a structure. For simplicity, however, we will refer primarily to the frame 20 of a sliding glass door, although the invention should not be construed as being limited to this application.

Figure 1:
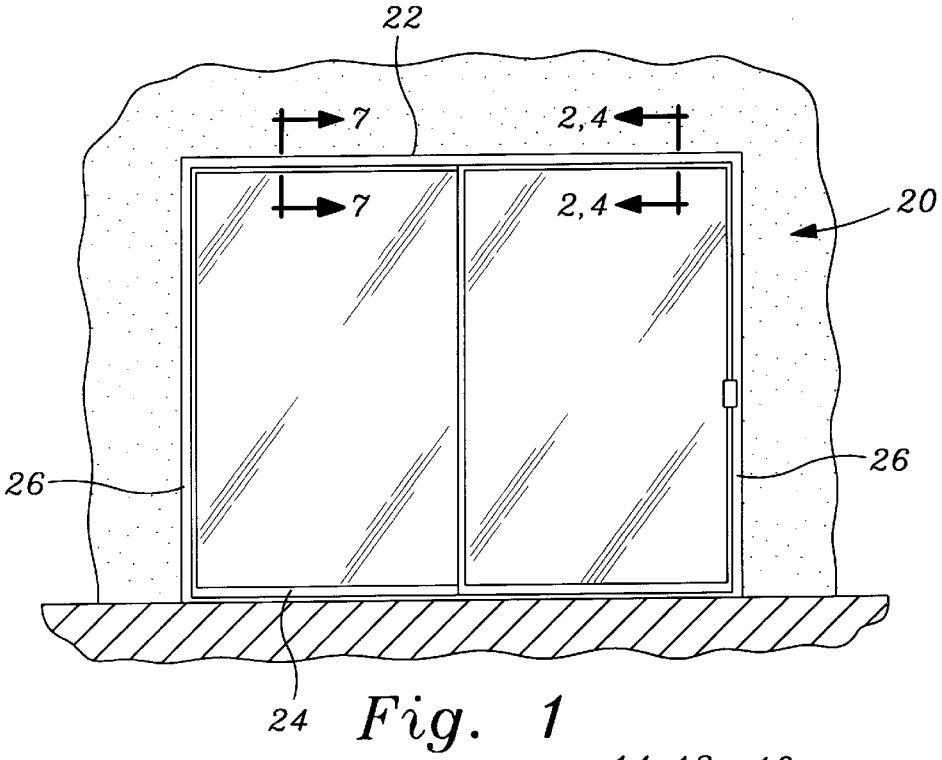
FIG. 1 is a front elevational view of the invention.
Figure 2:
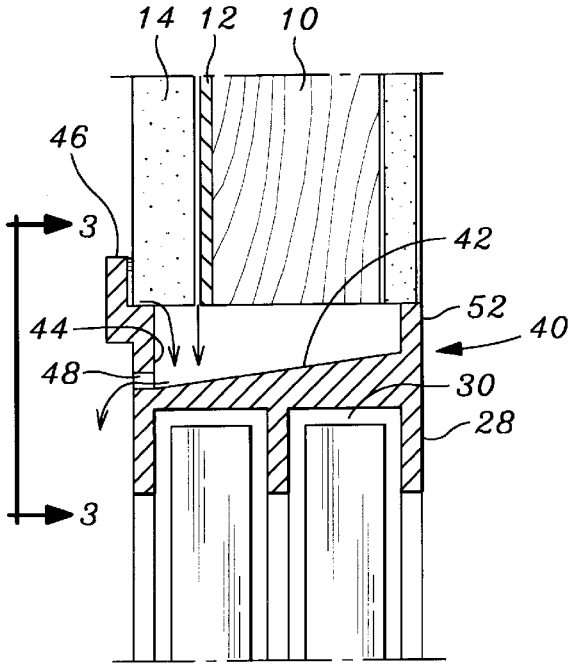
FIG. 2 is a partial sectional view of the first preferred embodiment, taken along line 2—2 in FIG. 1.
Figure 4:
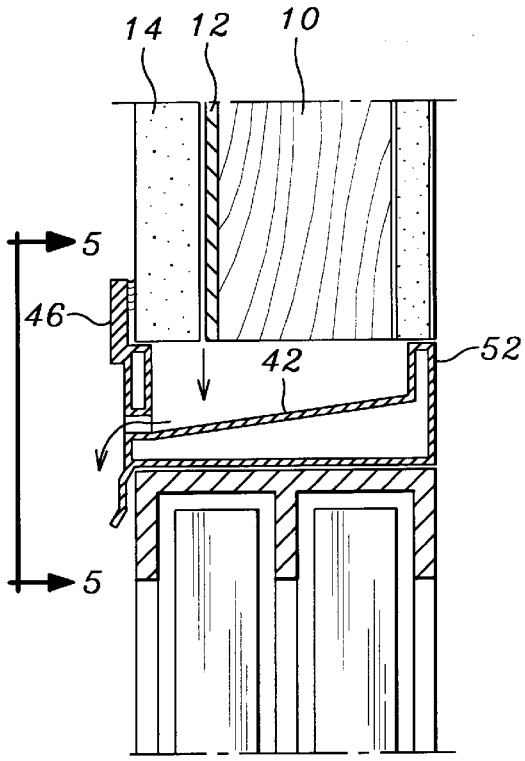
FIG. 4 is a partial sectional view of the second preferred embodiment, taken along line 4—4 in FIG. 1.
Figure 6:
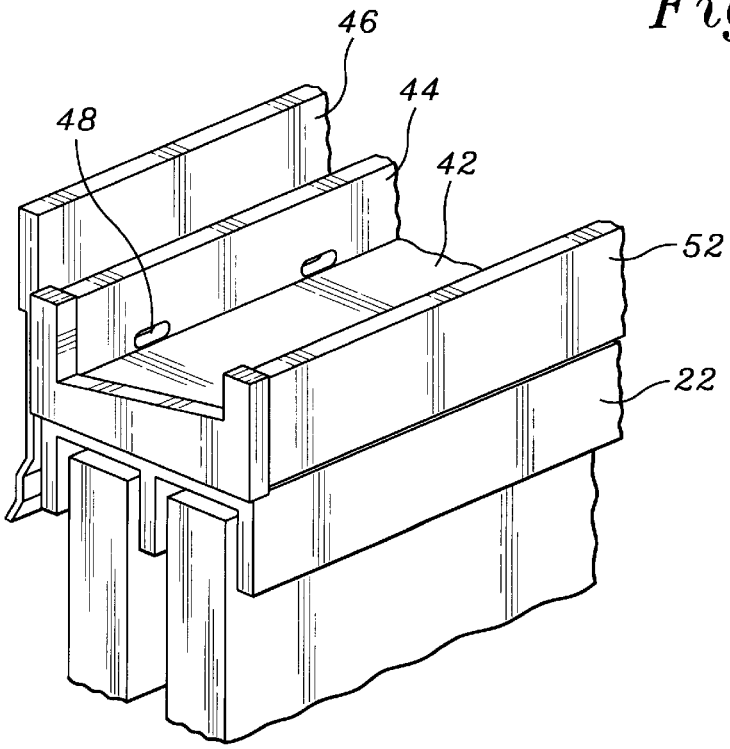
FIG. 6 is a partial perspective view of the second preferred embodiment of the invention.

As shown in FIG. 1, the frame 20 has a head 22, a sill 24, and two jambs 26, and the two jambs 26 are each connected to the head 22 and the sill 24. In its preferred configuration, the head 22, sill 24, and two jambs 26 are joined to form a rectangular frame. As shown in FIGS. 2, 4, and 6, the head 22 and sill 24 each preferably have three integral flanges 28. The three integral flanges 28 form two sliding door channels 30 on an inside surface of both the head 22 and the sill 24. The sliding doors 32 are slidably mounted within these sliding door channels 30. The sill 24 preferably includes a sill 24 water-stop. One example of such a water-stop is described in Dallaire et al., U.S. Pat. No. 4,922,661, herein incorporated by reference. In another preferred embodiment, wherein the frame 20 is for a window rather than a sliding door, the head 22 and sill 24 have four integral flanges 34 defining two sash receiving channels 36 and one screen receiving channel 38. In another embodiment, the frame 20 is adapted to mount a single pane of glass that cannot slide or open. It is important to note than this invention is useful for any exterior wall frame construction, and the inside surface of the frame 20 will be modified by those skilled in the art to accommodate the particular use of the frame 20. Products that are modified in this fashion are within the scope of this invention and should be considered equivalent.

Figure 3:
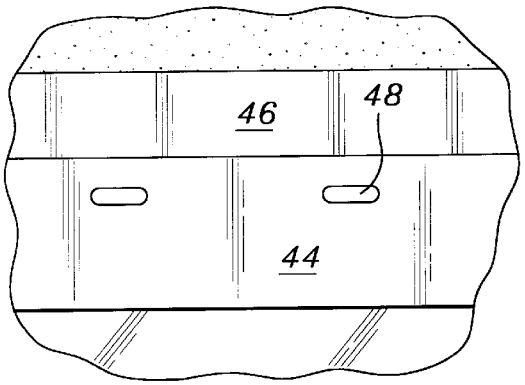
FIG. 3 is a partial front elevational view thereof taken along line 3—3 in FIG. 2.
Figure 5:
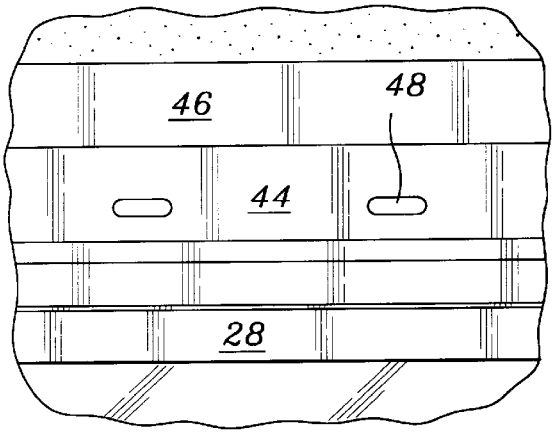
FIG. 5 is a partial front elevational view thereof taken along line 5—5 in FIG. 4.
Figure 7:
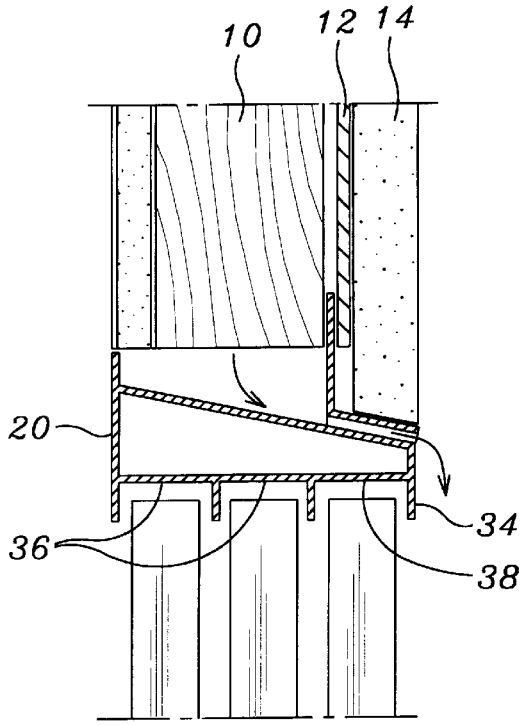
FIG. 7 is a partial sectional view thereof taken along line 7—7 in FIG. 1.
Figure 8:
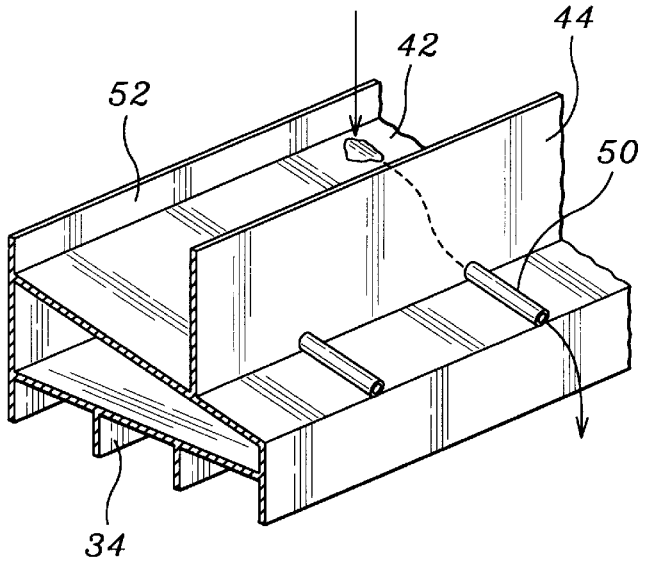
FIG. 8 is a partial perspective view of the third preferred embodiment of the invention.

The invention further includes a water stop 40 located at the head 22 of the frame 20. There are three preferred embodiments of the water stop 40. In the first embodiment, as shown in FIGS. 2–3, the water stop 40 is integral with the frame 20. This first embodiment is preferably used when tearing out the existing door of a structure and installing a replacement door having the integral water stop 40. In the second embodiment, as shown in FIGS. 4–6, the water stop 40 is a separate element that is be used in conjunction with a prior art door frame to achieve a structure similar to the first embodiment. This embodiment is useful for improving a door that leaks, without replacing the entire door. In the third embodiment, as shown in FIGS. 7–8, the frame 20 has an integral water stop 40 and further includes a drainage tube 50 that allows the frame 20 to be integrated directly into a new wall construction. This water stop 40 is designed for installation into new homes whose walls are being built at the time of installation. The head 22 of the frame 20 and the water stop 40 are modified to facilitate installation directly into the wall between the wooden frame 10 and the paper 12 and the exterior finish 14. The exterior finish 14 is generally stucco, sheet metal, or wood siding.

In the first embodiment, as shown in FIGS. 2–3, the head 22 of the frame 20 itself acts as the water stop 40. The head 22 has a top surface 42, a front sidewall 44 and a water containment means 52. The front sidewall 44 extends upwardly from the top surface 42 to form a barrier against water leaking over the frame 20 from the exterior of the structure. In its preferred configuration, the front sidewall 44 includes an upwardly extending flange 46 that fits against the exterior finish 14 of the structure to further exclude water. The space between the exterior finish 14 and the upwardly extending flange 46 is preferably sealed with caulking 64 to further prevent leakage. The front sidewall 44 has at least one weep hole 48 located adjacent to the top surface 42, the weep hole 48 being a conduit through the front sidewall 44. The weep hole 48 is preferably approximately 1.5 cm wide and 0.75 cm high, although many different sizes and shapes are acceptable. A preferred weep hole 48 construction is described in Riegelman, U.S. Pat. No. 3,199,156, herein incorporated by reference. In its preferred configuration, the water containment means 52 is a rear sidewall extending upwardly from the top surface 42 to prevent water from leaking from the top surface 42 of the head 22 into the interior of the structure. Furthermore, the top surface 42 is preferably slanted downward from the rear sidewall 52 to the front sidewall 44, so that any water leaking onto the top surface 42 runs down to the front sidewall 44 and out the weep hole 48. While the downward slant of the top surface 42 is usually enough to act as the water containment means, the rear sidewall 52 is preferably included to prevent leakage. Finally, the water containment means 52 preferably further includes a pair of end caps 62 that snap onto the front and rear sidewalls 44 and 52 and the top surface 42 to prevent water leakage over the sides of the frame 20.

Figure 9:
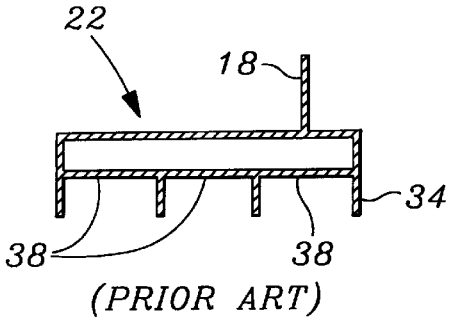
FIG. 9 is a side elevational sectional view of the prior art frame used in new construction.

The first embodiment is preferably used when tearing out the existing frame of a door and installing the improved frame 20 of the invention. The original prior art frame, as shown in FIG. 9, generally includes an upwardly directed fin 18 that fits between the wooden frame 10 and the paper 12 and exterior finish 14. During the original construction of the structure, the prior art frame was installed such that the upwardly directed fin 18 fits against the wooden frame 10 and the paper 12 is laid directly over the upwardly directed fin 18. Exterior finish 14 is then spread over the paper 12. If any water leaks through the exterior finish 14, the paper 12 channels the water down to and over the upwardly directed fin 18, excluding the water from the structure. Once the original frame is removed, this protection against leakage is lost. The first embodiment of the invention is a frame 20 having the above described structure that is capable of excluding water from the structure without an upwardly directed fin 18 integral with the wall of the structure. Any water leaking onto the top surface 42 tends to be trapped by the water containment means 52 and forced to flow to the front sidewall 44, where it drains through the weep hole 48.

In the second preferred embodiment, as shown in FIGS. 4–6, the water stop 40 is a separate structure, preferably a vinyl or aluminum extrusion, that is mounted on top of the head 22 of the frame 20. This water stop 40 has a top surface 42, a front sidewall 44 and a water containment means 52, as described above. The water stop 40 preferably further includes a downwardly extending sidewall opposite the front sidewall 44. The downwardly extending sidewall 60 prevents water from leaking between the water stop 40 and the head 22 of the frame 20. The water stop 40 preferably further includes a pair of end caps 62 that attach to the ends of the water stop 40. This construction allows the user to cut the extruded water stop 40 to a length that matches the window, and then snap on the end caps 62 to prevent leakage from the end of the water stop 62. By making the water stop 40 as a separate product, it is possible to produce the water stop 40 as an inexpensive extrusion product that can be used with prior art frames already on the market.

The third preferred embodiment, as shown in FIGS. 7–8, is very similar to the first embodiment. As with the first embodiment, the head 22 of the frame 20 includes integral elements to provide the water stop 40, including a top surface 42, a front sidewall 44 and a water containment means 52, preferably a rear sidewall. The structure has been modified, however, so that the frame 20 is suitable for use in new home construction. The front sidewall 44 extends upwardly from the top surface 42 approximately 1 inch from the edge of the frame 20 and is long enough to be used as an upwardly extending fin as in the prior art. The front sidewall 44 is positioned between the paper 12 and the wooden frame 10, as shown in FIG. 7. A drainage tube 50 runs from the weep hole 48 to the edge of the head 22. The drainage tube 50 allows water to flow from the weep hole 48, under the paper 12 and exterior finish 14 of the wall of the structure, and to the exterior of the structure. The invention preferably also includes end caps 62. Since this third embodiment is manufactured so that the water stop 40 is integral with the head 22 of the frame 20, the end caps 62 are also preferably integral to the frame 20.

The invention further includes a method for installing an improved exterior wall frame 20 construction to avoid leakage. The method first calls for providing a frame 20 having a head 22, a sill 24, and two jambs 26, the two jambs 26 each being connected to the head 22 and the sill 24. The method next calls for providing a water stop 40 having a top surface 42, a front sidewall 44 and a water containment means 52, the front sidewall 44 extending upwardly from the top surface 42 and having at least one weep hole 48. The water containment means 52 is preferably a rear sidewall. The water stop 40 preferably further includes a downwardly extending sidewall opposite the front sidewall 44. The downwardly extending sidewall prevents water from leaking between the water stop 40 and the head 22 of the frame 20. The water stop 40 is then mounted on top of the head 22 of the frame 20, preferably with an adhesive. The combination is then installed into a provided structure having an exterior wall. A hole the size of the frame 20 and water stop 40 is cut into the exterior wall and the frame 20 and water stop 40 is installed such that the weep hole 48 faces the exterior of the structure.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An exterior wall frame construction for excluding water such as rain, the construction comprising:

a frame having a head, a sill, and two jambs, the two jambs each being connected to the head and the sill; and the head of the frame having a top surface, a front sidewall and a water containment means the front sidewall, extending upwardly from the top surface, having at least one weep hole, wherein any water leaking onto the top surface tends to be trapped by the water containment means, and drains through the weep hole.

2. The construction of claim 1 wherein the water containment means is the top surface being sloped downward to the front sidewall.

3. The construction of claim 1 wherein the water containment means is a rear sidewall extending upwards from the top surface.

4. The construction of claim 3 wherein the top surface slopes downwardly from the rear sidewall to the front sidewall.

5. A combination frame and water stop comprising:

a frame having a head, a sill, and two jambs, the two jambs each being connected to the head and the sill; and a water stop having a top surface, a front sidewall and a water containment means, the front sidewall extending upwardly from the top surface and having at least one weep hole, the water stop being mounted on top of the head of the frame, wherein any water leaking onto the top surface tends to be trapped by the water containment means, and drains through the weep hole.

6. The construction of claim 5 wherein the water containment means is a rear sidewall extending upwards from the top surface.

7. The construction of claim 6 wherein the water containment means further includes a pair of end caps that connect the front and rear sidewalls and the top surface to form a water containment basin.

8. The construction of claim 6 wherein the top surface slopes downwardly from the rear sidewall to the front sidewall.

9. The construction of claim 5 wherein the water stop is integral with the head of the frame.

10. The construction of claim 5 wherein the water stop is a vinyl extrusion.

11. The construction of claim 5 wherein the water stop is an aluminum extrusion.

12. The construction of claim 5 wherein the water stop further includes a downwardly extending sidewall opposite the front sidewall.

13. A method for installing an improved exterior wall frame construction to avoid leakage, the method comprising the steps of:

a) providing a frame having a head, a sill, and two jambs, the two jambs each being connected to the head and the sill;

b) providing a water stop having a top surface, a front sidewall and a water containment means, the front sidewall extending upwardly from the top surface and having at least one weep hole;

c) mounting the water stop on top of the head of the frame;

d) providing a structure having an exterior wall;

e) providing a hole in the exterior wall that is the size of the frame and water stop; and f) installing the frame and water stop in the hole of the exterior wall such that the weep hole faces the exterior of the structure.

* * * * *

UNITED STATES PATENT AND TRADEMARK OFFICE

CERTIFICATE OF CORRECTION

PATENT NO. : 6,170,207 B1
DATED : January 9, 2001
INVENTOR(S) : Michael Saindon

It is certified that error appears in the above-identified patent and that said Letters Patent is hereby corrected as shown below:

Column 1,
Line 17, “a” should be deleted.

Column 2,
Line 60, “24” should be deleted and -- (not shown) -- should be added after “water-stop.”

Column 3,
Line 1, “than” should be replaced by -- that --.

Column 4,
Line 5, “exterior” should be replaced by -- The Exterior --.
Line 31, “62” should be replaced with -- 40 --.
Line 50, -- the -- should be inserted after “and.”

Signed and Sealed this

Tenth Day of August, 2004

JON W. DUDAS
*Acting Director of the United States Patent and Trademark Office*